US005516043A

United States Patent [19]

Manna et al.

[11] Patent Number: 5,516,043

[45] Date of Patent: May 14, 1996

[54] ULTRASONIC ATOMIZING DEVICE

[75] Inventors: Ronald R. Manna, Valley Stream; Vaclav Podany, New Fairfield; David Ng, Merrick, all of N.Y.; Thomas H. Costa, Charlestown, N.H.; Vernon Zeitz, deceased, late of Boca Raton, Fla., by Judith A. Robinson, legal representative

[73] Assignee: Misonix Inc., Farmingdale, N.Y.

[21] Appl. No.: 269,644

[22] Filed: Jun. 30, 1994

[51] Int. Cl.[6] ..... B05B 1/02

[52] U.S. Cl. ..... 239/102.2; 239/4; 239/499; 239/548

[58] Field of Search ..... 239/102.2, 102.1, 239/4, 548, 565, 499, DIG. 13

[56] References Cited

U.S. PATENT DOCUMENTS

| | | | |
|---|---|---|---|
| 2,466,182 | 4/1949 | Peeps | 239/548 X |
| 2,735,794 | 2/1956 | Pletcher | 239/DIG. 13 X |
| 3,104,672 | 9/1963 | Holdren | 239/DIG. 13 X |
| 3,214,101 | 10/1965 | Perron | 239/4 X |
| 3,317,139 | 5/1967 | Freeland | 239/102.2 |
| 3,361,352 | 1/1968 | Harris | 239/102.2 X |
| 3,702,685 | 11/1972 | Kirschke | 239/DIG. 13 X |
| 3,809,317 | 5/1974 | Bender | 239/DIG. 13 X |
| 4,756,324 | 7/1988 | Larsson | 239/DIG. 13 X |
| 4,764,180 | 8/1988 | Shaddock | 239/DIG. 13 X |
| 5,143,105 | 9/1992 | Katayama | 239/DIG. 13 X |
| 5,166,000 | 11/1992 | Singh et al. | 239/102.2 X |
| 5,314,117 | 5/1994 | Pavljak et al. | 239/102.1 |

FOREIGN PATENT DOCUMENTS

| | | | |
|---|---|---|---|
| 9209373 | 6/1992 | WIPO | 239/102.2 |

*Primary Examiner*—Andres Kashnikow
*Assistant Examiner*—Lesley D. Morris
*Attorney, Agent, or Firm*—R. Neil Sudol; Henry D. Coleman

[57] ABSTRACT

An ultrasonic atomizer device comprises an elongate body member having a proximal end and a distal end, the elongate body member being provided at least along a distal segment with a longitudinally extending liquid guide channel. The body member is further provided at its distal end with a radially enlarged head and at least one orifice communicating with the channel at a distal end thereof, the orifice extending to an atomizing surface disposed externally to the body in a recess on a proximal side of the head. The body is also provided with means for forming an operative connection with a source of ultrasonic vibrations.

19 Claims, 3 Drawing Sheets

ULTRASONIC ATOMIZING DEVICE

BACKGROUND OF THE INVENTION

This invention relates to an ultrasonic atomizing device or element such as an atomizer horn or a front driver. The atomizing device is operatively connected to an ultrasonic frequency generator for atomizing liquid fed to the device.

High power ultrasonic transducers have been employed in atomization of liquids for many years. In practice, the motion of a piezoelectric or magnetostrictive transducer is amplified either by the shape of the transducer itself or by the addition of a mechanical velocity transformer (so-called "horn") which is mechanically attached to its front driver. Liquid is brought into contact with the free or distal end of the vibratory element whereupon the oscillatory motion of the surface breaks the fluid into small droplets. The natural motion of the transducer/horn surface will impart a small velocity to the drop, thereby causing the droplets to form a fog which moves away from the surface slowly. Examples are found in U.S. Pat. Nos. 3,214,101, 4,153,201, 4,301,968 and 4,337,896.

In some ultrasonic atomizing devices known to the art, a gas moving device is employed to cause a gas stream to capture the fog and direct it in a certain direction at a higher rate of speed, as disclosed in U.S. Pat. No. 3,275,059. Devices such as these have been employed to atomize fuel for a combustion process, coat surfaces with a fine layer of material, nebulize drops of medicine into an airstream for treating bronchial distress, as well as for many other scientific and commercial applications well documented in the art.

Most of the known applications require a device to create droplets from a liquid stream and direct the resulting fog axially forward away from the transducer itself. To accomplish this, either the liquid feed to the transducer/horn face is via a concentric channel or passageway through the transducer and/or horn or the liquid feed enters the device at the nodal point of the transducer/horn perpendicularly to the long axis and intersects the axial feed hole, which is brought forward to the radiating face, as disclosed in U.S. Pat. No. 3,400,892. In another embodiment, the liquid feed is separate from the vibratory elements and takes the form of a sheath or feed tube having an outlet disposed to allow the liquid to drip or flow onto the radiating face of the transducer externally. Once the liquid contacts the radiating face of the device, the liquid is broken into droplets in the conventional manner. Such techniques are disclosed in U.S. Pat. Nos. 4,726,524 and 4,726,525.

The shape of the radiating face of an ultrasonic probe plays an important role in both the droplet size and spray pattern generated. However, all conventional probes either yield a spray pattern which is directed axially forward of the device and/or incorporate external liquid passageways in lieu of internal fluid guide channels.

Certain applications exist wherein devices known to the art would not be suitable for employment as a liquid atomizer. Examples of such applications are those which require a spray pattern which is radial with respect to the transducer/horn centerline and require a very thin or narrow horn due to the physical constraints of the system, thereby negating the possibility of using an external feed tube or sheath. Such applications would include the precision application of liquid reagents onto the interior side surfaces of a glass or plastic test tube or for coating the interior surfaces of a small diameter metal tubing with paint, anti-corrosive coating or magnetic media. In all of these cases, the spray pattern must be radially dispersed into very fine droplets. In some cases, the droplets must have an acceleration which has a vector pointed rearward, toward the transducer/horn itself. This would be necessary in cases where the dose of liquid to be atomized must be deposited upon the sidewall, thereby generally not allowing any of the material to contact the bottom surface of the test tube.

OBJECTS OF THE INVENTION

An object of the present invention is to provide an ultrasonic atomizer device such as a horn or front driver which atomizes and disperses liquid droplets in a spray or fog having a radial and/or rearward velocity component.

Another object of the present invention is to provide such an ultrasonic atomizer device wherein the liquid is fed to the atomizing surfaces along an axial channel in the atomizing device.

Another object of the present invention is to provide an ultrasonic atomizer device such as a horn or front driver which can be used to spray a coating of fine liquid droplets on a surface in a confined space.

A further object of the present invention is to provide a method for the atomization of a liquid.

These and other objects of the present invention will be apparent from the drawings and detailed descriptions herein.

SUMMARY OF THE INVENTION

An ultrasonic atomizer device comprises, in accordance with the present invention, an elongate body member having a proximal end and a distal end, the elongate body member being provided at least along a distal segment with a longitudinally extending liquid guide channel. The body member is further provided at its distal end with a radially enlarged head and at least one orifice communicating with the channel at a distal end thereof, the orifice extending to an atomizing surface disposed externally to the body on a proximal side of the head. The body is also provided with means for forming an operative connection with a source of ultrasonic vibrations.

According to another feature of the present invention, the body member is provided proximally of the head with a recess to which the orifice extends. Preferably, the recess is annular. In most cases, a plurality of orifices will extend to the recess from the distal end of the liquid guide channel in the body member.

According to a more specific feature of the present invention, the body member is further provided, proximally of the recess, with a radially outwardly extending bead which in part defines the recess. Where the recess is annular, the bead is also annular. The bead or hump prevents the rearward or proximal migration of unatomized fluid by the surface action of the resonating device.

According to a further feature of the present invention, the liquid guide channel is enlarged at its distal end to form a plenum for liquid to be atomized by the device during an atomizing operation. Accordingly, the orifice extends from the plenum on an inner side to the recess on an outer side of the body member.

In accordance with one embodiment of the present invention, the orifice extends in a radial direction. This results in a spray which is generally radial. In an alternative embodiment, the atomizing surface faces at least partially in a proximal direction and is a surface of the head. In this case, the atomized spray has a rearward or proximally directed velocity component.

The recess may have different, alternative cross-sections, e.g., semicircular or triangular.

Pursuant to another specific feature of the present invention, the atomizer head has a first outer diameter and the bead has a second outer diameter, the first outer diameter being at least as great as the second outer diameter. In addition, the plenum may be formed in part by inserting a plug into the enlarged portion of the liquid guide or feed channel.

According to yet another feature of the present invention, a cannula is connected to the body member at the proximal end thereof and extends through the liquid guide channel to approximately the distal end thereof. This feature enables the injection of the fluid into the plenum chamber directly and concomitantly allows the liquid to enter the atomizing horn or front driver without mechanically increasing the operating impedance of that element, thereby limiting power consumption of the ultrasonic device. As a result, the liquid will be kept cooler and will not be exposed to ultrasonic vibrations essentially until the atomization action is required, thereby not allowing the ultrasound to change the nature of the liquid. The cannula will also limit the dead volume of the system, thereby minimizing the amount of the fluid needed to operate the system and improve the precision of metering of the fluid to be atomized.

A method for depositing a liquid substance on a surface comprises, in accordance with the present invention, the steps of (a) providing an atomizer device including an elongate body member provided at least along a distal segment with a longitudinally extending liquid guide channel, (b) conducting the liquid along the channel from a proximal end of the body member to a distal end thereof, (c) guiding the liquid from a distal end of the channel to an outer surface of the body member, (d) atomizing the liquid at the outer surface, and (e) providing the atomized liquid with a substantial proximally directed velocity component.

In one embodiment of the invention, the liquid to be atomized is guided to a portion of the outer surface of the atomizer device body member facing at least partially in a proximal direction. The angle of the atomizing surface thus serves to provide the atomized liquid with a substantial proximally directed velocity component.

Pursuant to additional features of the present invention, the method further comprises the steps of maintaining liquid in a recess formed at the outer surface by a bead on the body member and at least inhibiting backflow of liquid from the outer surface towards the proximal end of the body member.

An ultrasonic atomizing horn or front driver in accordance with the present invention has a liquid feed which is axial and concentric to the centerline of the transducer/horn in the distal segment thereof. This structure facilitates a minimization in the transverse dimensions of the transducer horn or front driver, thereby enabling the instrument to be used in narrowly confined spaces.

An ultrasonic atomizing horn or front driver in accordance with the present invention provides a fog of fine liquid droplets with a spray pattern which is radial to the centerline of the horn, and which optionally has a backward or proximally directed component, depending upon the location of the orifice holes. As a further improvement on current art, the liquid orifices extend from a plenum or well which limits the possibility of clogging and obstruction due to foreign matter or feed tubes and provides for a more manufacturable device as well. The entire device is fairly simple in embodiment, yielding a device which is easy to manufacture in large quantities at a reasonable cost.

The input or proximal end of an ultrasonic atomizing horn in accordance with the present invention terminates in a threaded stud which allows attachment to an ultrasonic transducer of either piezoelectric or magnetostrictive design. Alternatively, the ultrasonic atomizing device may be a front driver element or front mass of an ultrasonic transducer of either piezoelectric or magnetostrictive design. This design reduces the overall length of the device and thereby allows the invention to be employed in applications where physical constraints on lengths must be made.

The external or distal end shape of the horn or front driver is selected so as to amplify the input ultrasonic vibration to an amplitude sufficient to permit effective atomization of a fluid into fine droplets.

The distal end or head of the horn is a conical or bell shape which is essentially hollow. The plug installed into the distal end of the atomizing member effectively blocks axial liquid flow. The orifice holes are drilled through the side walls of the body member to vent the plenum chamber created by the side walls of the horn and the plug. The number of holes is not essential to the present invention, but can be as few as one, depending upon the shape of the spray pattern required. The exact location of holes affects the final spray pattern characteristic and does have an impact upon the final spray droplets size.

DETAILED DESCRIPTION

Figure 1:
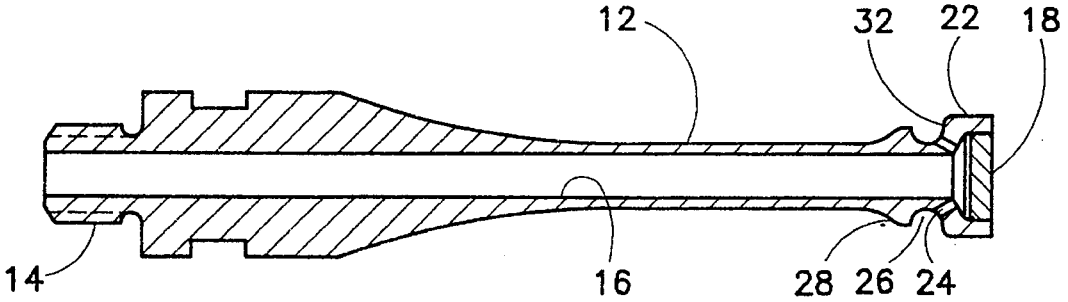
FIG. 1 is a longitudinal cross-sectional view of an ultrasonic atomizing horn in accordance with the present invention.
Figure 3:
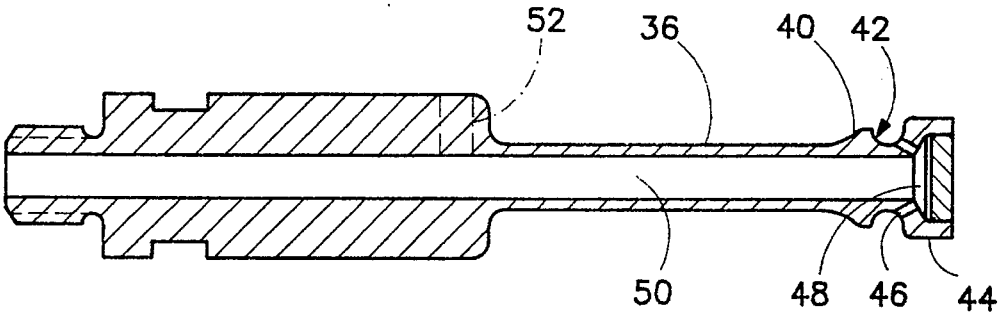
FIG. 3 is a longitudinal cross-sectional view of another ultrasonic atomizing horn in accordance with the present invention.

As illustrated in FIGS. 1 and 3, an ultrasonic atomizer horn comprises an elongate body member 12 of an exponentially tapering design provided at a proximal or inlet end with a threaded stud 14 for forming an operative connection to a piezoelectric or magnetostrictive ultrasonic transducer (not shown). A separate stud may be used if proper liquid sealing techniques are employed. The mating surface of the horn should be flat and smooth for maximum transmission efficiency.

Body member 12 has a longitudinal or axial channel or bore 16 for guiding a liquid to be atomized from the proximal end of the body member 12 to a distal or outlet end thereof. At the distal end of body member 12, channel 16 is enlarged to form a plenum chamber 20. A terminal plug 18 is inserted into channel 16 at the enlarged distal end thereof.

Body member 12 is further provided at its distal end with a radially enlarged head 22 and a plurality of circumferentially equispaced orifices 24 communicating on an inner side with plenum chamber 20. On an outer side, orifices 24 communicate with an annular recess 26 which is defined on a proximal side by an annular, radially outwardly extending bead 28 and on a distal side by atomizer head 22. Bead or hump 28 prevents a rearward or proximal migration of unatomized fluid during use of the device.

Orifices 24 extend, at an angle al with respect to a longitudinal axis 30 of body member 12, to a proximally facing atomizing surface 32 disposed externally to body member 12 on a proximal side of head 20. Most of the liquid leaving orifices 24 is atomized by surface 32 which imparts to the liquid droplets an average velocity having a proximally directed vector component.

Figure 2:
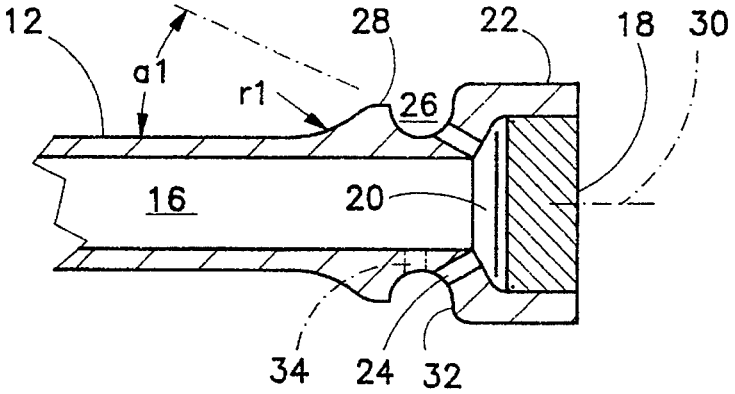
FIG. 2 is a longitudinal cross-sectional view, on an enlarged scale, of a distal end of the ultrasonic atomizing horn of FIG. 1.

As indicated in FIG. 2 by dot-dash lines, body member 12 may be provided alternatively or additionally with radially oriented liquid guiding orifices 34. Such orifices 34 result in a spray which is generally radial.

With radial orifices 34, some or all of the fluid will be atomized before it reaches surface 32. Due to the radial vibrations present at the surface or recess 26 about the outlet end of orifice 34, the spray pattern will tend to be substantially radial, without proximally directed acceleration present with the use of orifices 24. Therefore, when coating the inside surface of a tube with an atomizing horn having only radial orifices 34, the spray pattern will be tighter and narrower than where proximally directed orifices 24 are used. In addition, the spray droplets provided by this second design are somewhat larger. In most applications, the differences seen are not critical, but could be significant in the most demanding of applications.

The exterior shape of horn 12 follows a general exponential curve from its input end to the final diameter which is generally somewhat thinner. The input and final diameters and the length of the taper are not critical to the invention except that they must be in agreement with good design practice when specifications such as resonant frequency, horn gain, and flexural stiffness are taken into consideration.

At bead 28, the cross section of horn 12 is increased with a radius of curvature r1 such that the stresses at the bead will be below the safe operating stresses for the material employed. The outer diameter of bead 28 is somewhat arbitrary, but is generally twice that of the minimum diameter of the exponential taper. Continuing down the length of the horn, this maximum bead diameter is maintained for a short distance. Recess or cove 26 is then machined into the body of horn 12. After recess or cove 26, the diameter of horn 12 is brought to that of bead 28 or greater to form head 22. Head 22 is substantially cylindrical diameter, i.e., has a substantially uniform diameter, and the end is blunt.

In manufacturing horn 12, channel or bore 16 is drilled from the input or proximal end of horn 12 straight through the long axis and out the distal end. The diameter of channel 16 is largely arbitrary, but enough material must remain in the wall of the horn to withstand the forces imposed by ultrasonic vibrations. From the distal end of horn 12, a larger bore is made which projects only so far into horn 12 as to leave a wall of thickness in the tip end sufficient to handle the loading imposed by the vibration and the liquid pressures encountered within the horn. Plug 18 is inserted into the distal or tip end to seal the end against liquid seepage. Plug 18 can be of the same material as horn body 12 or not, depending upon the design considerations. Likewise, plug 18 may be held in place by friction, adhesives or welding/brazing. It is to be noted that plug 18 does not fill the entire void left by the distal end bore. This effectively creates well or plenum 20 in which the liquid may pool. Pursuant to an alternative manufacturing technique, the distal tip of horn 12 may be machined as a cap which is then brazed, welded or glued onto the balance of the horn.

Orifices 24 are drilled into surface 32 to intersect plenum 20 or channel 16. Orifices 24 are generally drilled prior to the insertion of plug 18, so that the interior surfaces can be deburred and cleaned via known techniques. Also, a hole (not shown) may be drilled into plug 18 itself, so that a portion of the spray pattern is directed downward in standard manner.

When horn 12 is attached to a suitable transducer which incorporates a concentric liquid feed, a liquid channel is effectively created through the transducer into the horn itself. The mechanical connection of the screwed joint has been shown to be sufficient to seal against liquid seepage in all but the most high pressure applications. In that case, an elastomer seal may be employed. When the liquid is introduced into the system, it flows down channel 16 and into plenum chamber 20. The differential pressure between the liquid in channel 16 and the outside environment provides the impetus to force the liquid from plenum chamber 20, through orifices 24 and onto surface 32. Once ultrasonic energy is applied to horn 12, the horn will begin to vibrate sympathetically with it. Surface 32 will vibrate in space at a frequency set by the natural resonant frequency of the system. Experience has shown that frequencies between 15 khz and 100 khz are effective design frequencies for this type of device.

Once the fluid is on surface 32, it will be broken into droplets via mechanisms which are described in greater detail in U.S. Pat. No. 3,103,310. Generally, the higher the frequency, the finer the droplet size which may be obtained, for a given amplitude of vibration. The resulting spray pattern will be backward and radially outward, given that the natural motion of surface 32 and its sloping shape will impart acceleration in that direction. If horn 32 is inserted into a tube or small chamber, the spray will contact the inner surface of the tube or chamber and stick before the droplets have any significant opportunity to fall, thereby creating a ring spray pattern localized in the vicinity of orifices 24.

Bead or hump 28 will prevent unatomized liquid from climbing up the exterior surface of horn 12 and out of the atomization zone due to liquid surface tension and the ultrasonic pumping effects. Bead 28 imparts a distally directed force to the fluid which comes into contact with the bead from the distal end of the horn 12, as well as atomizing that fluid. Therefore, the liquid is effectively contained within recess 26. It is to be noted that horn 12 will atomize fluid well without bead 28 and the elimination of the bead for simple applications has been anticipated. In some cases, recess 26 may be machined into the body of horn 12, thus eliminating the need for bead 28.

FIG. 3 shows an ultrasonic transducer horn 36 which has a step or shoulder 38. At a distal end, horn 36 is provided with a circumferential bead 40, an annular recess 42, an enlarged head 44, and orifices 46 extending to recess 42 from a plenum chamber 48 at the distal end of an axial channel 50, as discussed hereinabove with reference to FIGS. 1 and 2. Channel 50 may extend entirely the length of horn 36 or may extend to a radial feed bore 52 located at a nodal point of horn 36.

Figure 4:
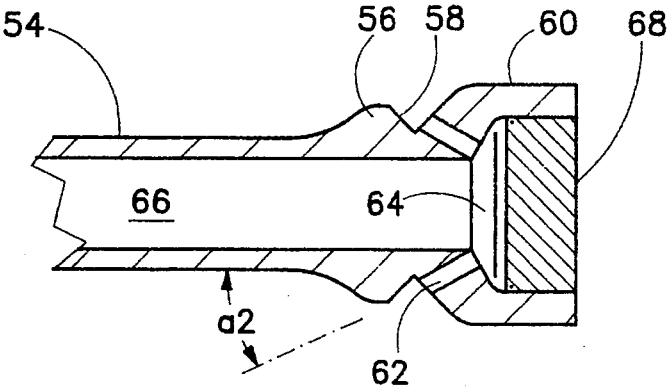
FIG. 4 is a longitudinal cross-sectional view, on an enlarged scale, of a distal end of a modified ultrasonic atomizing horn in accordance with the present invention.

Recesses 26 and 42 have substantially semicircular cross-sections. Other cross-sections are possible. FIG. 4 depicts an ultrasonic transducer horn 54 provided at a distal end with a circumferential bead 56 and an annular recess 58 of triangular cross-section. Horn 54 has an enlarged conical or cylindrical head 60. Orifices 62 extend at an angle a2 to recess 58 from a plenum chamber 64 at the distal end of an axial channel 66. Plenum chamber 64 is formed in an expanded portion of channel 66 and is defined in part by a plug 68 inserted into the channel from the distal end thereof.

Figure 5:
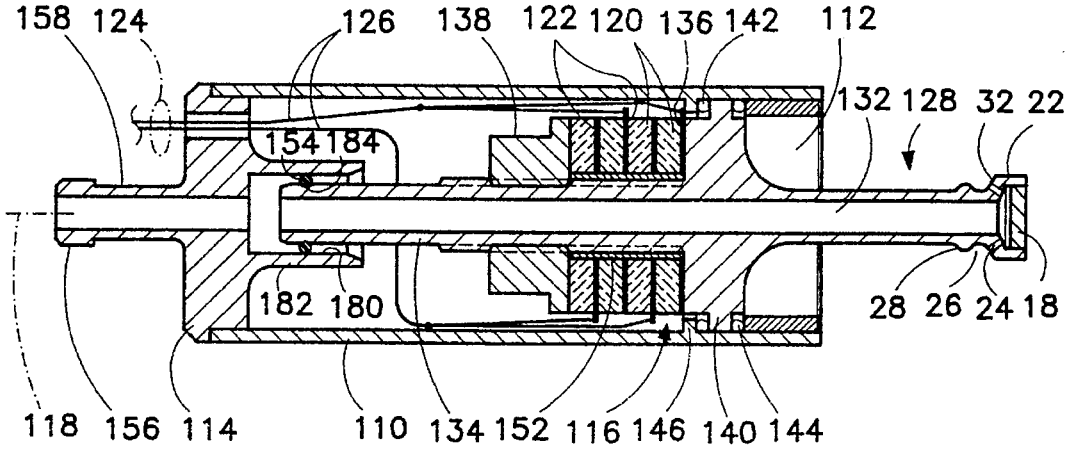
FIG. 5 is a longitudinal cross-sectional view of an ultrasonic transducer device with a front mass or driver in accordance with the present invention.

FIG. 5 depicts an ultrasonic atomizing device with a front driver 128 provided at a distal end with a structure identical to that of the horn described hereinabove with reference to FIGS. 1 and 2. The same reference numerals are used to designate identical structures.

The electromechanical ultrasonic transducer device of FIG. 5 further comprises a casing 110 having a locking ring 112 at a distal end and a rear case cover 114 at a proximal end. An acoustic wave generator 116 is disposed inside casing 110 for generating an acoustic type vibration in response to an electrical signal. Acoustic wave generator 116 has an axis 118 extending between the proximal end and the distal end of casing 110. Wave generator 116 includes a plurality of annular piezoelectric crystal disks 120 arranged in a stack with a plurality of transversely oriented metal electrodes 122. This assembly of disk-shaped piezoelectric crystals 120 and electrodes 122 defines a central channel (not labeled) which is coxial with axis 118.

Wave generator 116 is energized to vibrate at an ultrasonic frequency by a high-frequency excitation voltage or electrical signal transmitted over a coaxial cable 124. Cable 124 is connected to rear case cover 114 and terminates in a plurality of electrical transmission leads 126 extending inside casing 110 to electrodes 122. In rear case cover 114, cable 124 passes through a hole (not designated) provided with a strain relief fitting or an electrical connector of any type. A separate earth grounding lead may be connected to crystal assembly or wave generator 116 and casing 110 to provided electrical safety where needed.

A wave transmission member in the form of a front driver 128 is in acoustic contact with wave generator 116 for transmitting the vibration from generator 116 to atomizing surface 32 outside casing 110. Front driver 128 is conceived as an ultrasonic atomizing horn, atomizing surface 32 being located at the distal end of the horn.

Front driver 128 is an integral or unitary mass defining a fluid guide channel or bore 132 with a continuous or uninterrupted wall extending axially through acoustic wave generator 116 to the proximal end of casing 110 for guiding fluid between the atomizing surface and the proximal end of the casing during operation of acoustic wave generator 116. More particularly, front driver 128 includes a stud 134 extending axially through the central channel of crystal assembly or wave generator 116. Fluid guide channel 132 extends through stud 134. Because front driver 128 includes stud 134 as an integral component so that a continuous and uninterrupted fluid flow channel 132 may be provided through crystal assembly or wave generator 116, there is no significant probability that fluid will escape from the channel into casing 110 in the area of the crystal assembly or wave generator.

Front driver 128 also includes a shoulder or crystal mating surface 136 for supporting crystal assembly or wave generator 116 in a Langevin sandwich. Crystal assembly or wave generator 116 is in contact with shoulder 136 to transmit the generated ultrasonic vibration through front driver 128. Generator 116 is pressed between shoulder 136 and a rear mass 138 attached to stud 134 at a rear or proximal end thereof. Stud 134 has an external thread (not designated) matingly engaging an internal thread (not designated) on rear mass 138, thereby enabling a selective tightening of rear mass 138 to press crystal assembly or wave generator 116 against shoulder 136 of front driver 128. To that end, rear mass 138 is provided with grooves, a hexagonal cross-section, or wrench flats or holes, for receiving an adjustment wrench (not shown) or other tool to facilitate screwing down of the rear mass 138 to the proper torque.

As additionally illustrated in FIG. 5, front driver 128 is provided with a radially and circumferentially extending flange 140 for mounting front driver 128 to casing 110. The flange is flanked by two elastomeric O-rings 142 and 144. Proximal O-ring 142 is sandwiched between flange 140 and an internal rib 146 inside casing 110, while distal O-ring 144 is sandwiched between flange 140 and locking ring 112. Flange 140 is located at a theoretical node point of wave generator 116 and front driver 128, while O-rings 142 and 144 serve to acoustically decouple flange 140 and accordingly front driver 128 from casing 110. A plurality of roll pins (not shown) may be attached to front driver 128 along flange 140 for enabling a limited pivoting of front driver 128 relative to casing 110.

An insulator such as a sleeve 152 of polytetrafluoroethylene in inserted between stud 134 and crystal assembly or wave generator 116, along a middle segment of stud 134, while at a rear or proximal end, stud 134 is surrounded by an elastomeric O-ring seal 154 made of an acoustically compliant material inserted between the stud and rear case cover 114. Seal 154 serves to form a fluid tight seal between stud 134 and casing 110 and is spaced from crystal assembly or wave generator 116. To that end, stud 134 extends beyond rear mass 138 on a side of rear mass 138 opposite crystal assembly or wave generator 116.

More particularly, the rear or proximal end of stud 134 is inserted into a recess 180 formed by a collar-like extension 182 of rear case cover 114. O-ring seal 154 is seated between collar-like extension 182 and stud 134, in an annular depression or shallow groove 184 on the stud.

Casing 110 and, more specifically, rear case cover 114, includes a port element 156 at the free end of a tubular projection 158 on a side of rear case cover 114 opposite collar-like extension 180. Port element 156 serves in the attachment of liquid transfer conduits (not shown) to casing 110 at a rear or proximal end of front driver 128. Port element 156 may take the form of tapered piped threads, straight threads, luer type fittings or welded connectors.

The ultrasonic atomizing assembly of FIG. 5 shortens the entire length of the system which is needed for certain applications. Those schooled in the art will realize that the transducer can be designed to give identical frequency and amplitude response to that of a separate horn and transducer assembly, but be approximately half as long, since the unit is now only one half a fundamental wavelength as opposed to the full wavelength of a separate transducer/horn system.

In cases where the tip of the horn must be projected further than is allowed by the full wavelength system, coupler elements may be engineered to extend the length of the horn. The design and construction of these elements are well described in prior art and texts.

In the embodiments discussed hereinabove with reference to the drawings, the liquid is pumped into the horn via the transducer and has been in direct contact with the interior of the horn for the full length of the channel. In most applications, this method of liquid feed is practical and acceptable. However, in certain situations, it would be advantageous to introduce the fluid into the region of the liquid orifices only, thereby isolating the fluid from the horn body until the last moment before atomization. Such applications would include, but not be limited to those where the fluid might be damaged or chemically changed due to prolonged exposure to ultrasound energy or where the fluid is viscous and would require high static pressures for liquid transport. Here, the internal pressure in the horn would cause a high mechanical and electrical loading on the system, sometimes requiring more energy than would be available from the transducer or generator.

Figure 6:
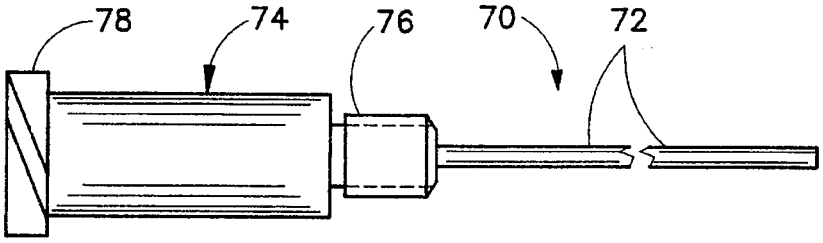
FIG. 6 is side elevational view of a fluid transport cannula in accordance with the present invention.

FIG. 6 shows a cannula device 70 for introducing a fluid into a well or plenum of a horn or front driver so that the internal channel of the horn is not used as a pipeline. Cannula device 70 includes a cannular or tube 72, generally made of stainless steel, with a fitting 74 provided at one end for fixing cannula device 70 to the proximal end of an ultrasonic transducer assembly and thus to the proximal end of an atomizing horn or front driver. Fitting 74 has external threads 76 at one end to engage the fitting in the transducer and effect a liquid tight seal. The nature of the threads are not critical to the invention and may be of any commercial or military standard type. The other end 78 of fitting 74 is likewise not critical and can be threaded or smooth tapered to mate with standard syringe fittings of the luer type. The interior of fitting 74 is rendered hollow by a through bore. Cannula or tube 72 is pressed, glued or welded into this bore to render the cannula air and liquid tight.

Figure 7:
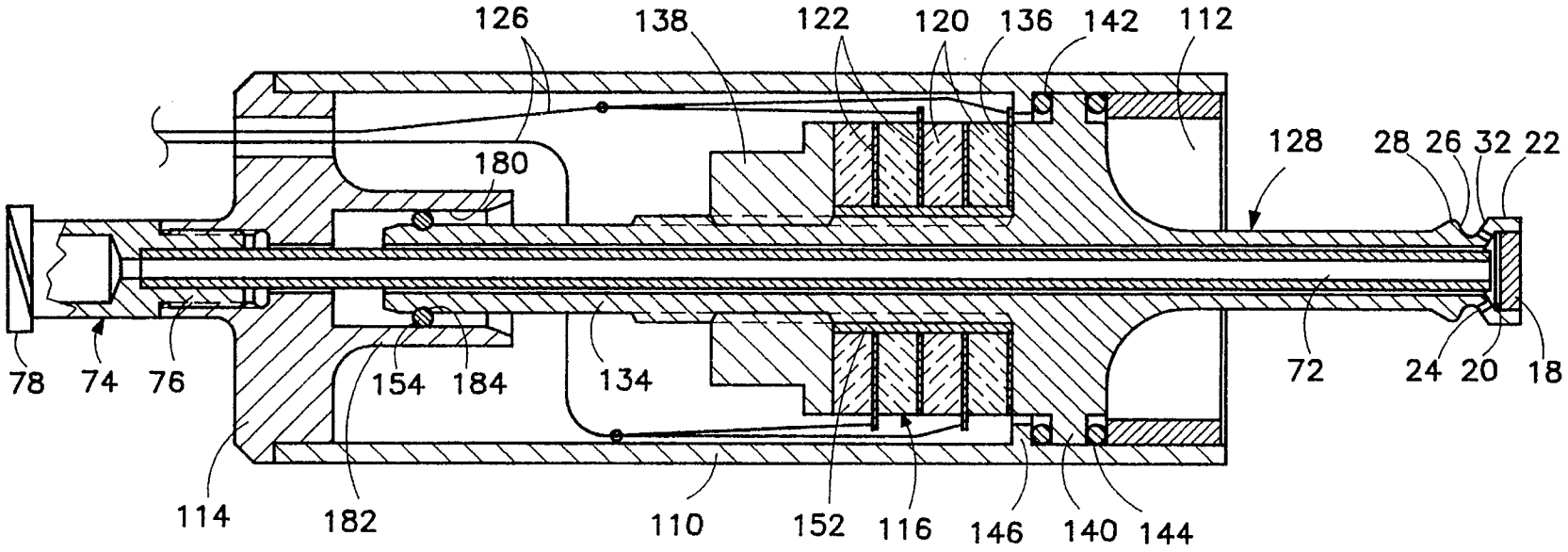
FIG. 7 is a longitudinal cross-sectional view simlar to FIG. 5, showing the ultrasonic transducer device of that drawing figure with the fluid transport cannula of FIG. 6 in operative position.

FIG. 7 illustrates cannula device 70 of FIG. 6 in use with the ultrasonic transducer assembly of FIG. 5. As illustrated in FIG. 7, cannula or tube 72 has an overall length to extend through ultrasonic transducer casing 10 and the entire length of front driver or atomizer horn 128 so that a distal end of cannula or tube 72 protrudes into well or plenum chamber 20 of front driver or horn 128. The distal end of cannula or tube 72 should not touch plug 18, of course.

Cannula or tube 72 has an outer diameter which is smaller than the bore diameter of the vibratory elements, so as not to touch the vibratory elements and therefore become part of the vibratory stack itself. In this manner, no ultrasonic energy will be imparted to the liquid until it contacts the interior of front driver or horn 128 at plenum chamber 20.

In an alternative embodiment of this principle, a fluorocarbon tube is inserted through piezoelectric element stack or acoustic wave generator 116 so that the end of the tube protrudes through the stack and into the well itself. The other end of the tube would have a fitting installed such as those found in liquid chromatography systems currently on the market. Both embodiments achieve the same results of liquid isolation, however, the solid cannula allows more precise location of the cannula end in the well itself.

Horns 12 and 36 are manufactured primarily of titanium alloy and stainless steels, but other materials, such as aluminum alloys, should perform as well.

It is to be noted that ultrasonic horns or front drivers of other designs may incorporate the principles of the instant invention. For example, a horn may have a catenoidal taper rather than an exponential taper as illustrated in FIG. 1 and bear the features shown in FIG. 2 or 4.

An ultrasonic horn or front driver as described herein should have tensile and acoustic properties which render it a suitable for use as an ultrasonic resonator. Currently, aluminum and titanium appear to be the best choices, however 300 or 400 series stainless steels and ceramics have been shown to be suitable in some cases as well. For more complete information on the characteristics and design techniques needed to create these horns, the reader is referred to such texts as *Ultrasonics* by Benson Carlin (1960, McGraw-Hill) and *Ultrasonic Engineering* by Fredericks and Sonics by Hueter & Bolt (1955, J. Wiley & Sons Inc.).

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. An ultrasonic atomizer device comprising an elongate body having an inlet end and an outlet end, said body being provided at least along a distal end segment with a longitudinally extending liquid guide channel, said body being further provided at said outlet end with a radially enlarged head, said body having at least one orifice communicating with said channel at a distal end thereof and extending to an atomizing surface disposed externally to said body on a side of said head facing said inlet end, said body being provided at said inlet end with means for forming an operative connection with a source of ultrasonic vibrations.

2. The device defined in claim 1 wherein said body is provided with a recess on a side of said head facing said inlet end, said orifice extending to said recess.

3. The device defined in claim 2 wherein said body is provided, on a side of said recess facing said inlet end, with a radially outwardly projecting bead which in part defines said recess.

4. The device defined in claim 3 wherein said bead is annular and said recess is annular.

5. The device defined in claim 4 wherein said head has a first outer diameter and said bead has a second outer diameter, said first outer diameter being at least as great as said second outer diameter.

6. The device defined in claim 2 wherein said channel is enlarged at its distal end to form a plenum chamber for liquid to be atomized by the device during an atomizing operation, said orifice extending from said plenum chamber on an inner side to said recess on an outer side.

7. The device defined in claim 2 wherein said orifice extends in a radial direction.

8. The device defined in claim 2 wherein said atomizing surface faces at least partially towards said inlet end and is a surface of said head.

9. The device defined in claim 2 wherein said recess is semicircular in cross-section.

10. The device defined in claim 2 wherein said recess is triangular in cross-section.

11. The device defined in claim 1 wherein said channel has an enlarged portion at said outlet end to form a plenum chamber for liquid atomized by the device during an atomizing operation, said orifice extending from said plenum to said atomizing surface.

12. The device defined in claim 11, further comprising a plug inserted into said enlarged portion of said channel.

13. The device defined in claim 1 wherein said orifice extends in a radial direction.

14. The device defined in claim 1 wherein said orifice extends at least partially towards said inlet end to a predetermined surface of said head facing towards said inlet end, said atomizing surface including said predetermined surface.

15. The device defined in claim 1, further comprising a cannula connected to said body at said inlet end thereof and extending through said channel to approximately said outlet end.

16. A method for depositing a liquid substance on a surface, comprising the steps of:

providing an ultrasonic atomizer device including an elongate body provided at least along an outlet segment with a longitudinally extending liquid guide channel;

conducting said liquid along said channel from an inlet end of said body to an outlet end thereof;

guiding said liquid from an outlet end of said channel to an outer surface of said body;

transmitting ultrasonic vibrations along said body from said inlet end thereof;

in response to the ultrasonic vibrations transmitted along said body, atomizing said liquid at said outer surface; and providing the atomized liquid with a substantial velocity component directed back towards said inlet end of said body.

17. The method defined in claim 16 wherein said step of guiding includes the step of guiding said liquid to a portion of said outer surface facing at least partially towards said inlet end of said body.

18. The method defined in claim 16, further comprising the step of maintaining liquid in a recess formed at said outer surface by a bead on said body.

19. The method defined in claim 16, further comprising the step of at least inhibiting backflow of liquid from said outer surface towards said inlet end of said body.

* * * * *